United States Patent [19]

Shaw

[11] Patent Number: 5,058,479

[45] Date of Patent: Oct. 22, 1991

[54] COLLAPSIBLE GUITAR

[76] Inventor: Eric D. Shaw, 1126 Lincoln Ave., Steamboat Springs, Colo. 80477

[21] Appl. No.: 568,075

[22] Filed: Aug. 16, 1990

[51] Int. Cl.[5] ..... G10D 3/00

[52] U.S. Cl. ..... 84/291; 84/327

[58] Field of Search ..... 84/267, 291, 293, 327

[56] References Cited

U.S. PATENT DOCUMENTS

| | | | |
|---|---|---|---|
| 1,768,261 | 6/1930 | Larson | 84/291 |
| 1,945,162 | 1/1934 | Rasmussen | 84/327 |
| 3,302,507 | 2/1967 | Fender | 84/267 |
| 3,396,621 | 8/1968 | Dycus | 84/293 |
| 3,416,399 | 12/1968 | Baldoni | 84/293 |
| 3,657,462 | 4/1972 | Robinson | 84/267 X |
| 3,910,151 | 10/1975 | Copeland | 84/267 |
| 3,974,730 | 8/1976 | Adams | 84/291 |
| 4,073,211 | 2/1978 | Jorgensen | 84/291 |
| 4,111,093 | 9/1978 | Field | 84/267 |
| 4,112,804 | 9/1978 | Cecchini | 84/267 X |
| 4,191,085 | 3/1980 | Litwin | 84/293 |
| 4,592,265 | 6/1986 | Steinberger | 84/327 |
| 4,686,882 | 8/1987 | Shaw | 84/291 |
| 4,770,079 | 9/1988 | Mastroianni | 84/291 |
| 4,873,908 | 10/1989 | Moore | 84/291 |

*Primary Examiner*—Brian W. Brown

*Attorney, Agent, or Firm*—John E. Reilly

[57] ABSTRACT

An acoustical guitar is made up of a central body section having collapsible wing panels slidably interconnected to opposite sides of the body to form a common sound chamber, and a neck is releasably connected to one end of the body. The interior of the body is reinforced by a combination of truss rods and an adjustable brace member to retain optimum alignment within the body itself and between the body and wing panels.

18 Claims, 4 Drawing Sheets

COLLAPSIBLE GUITAR

This invention relates to stringed musical instruments; and more particularly relates to a novel and improved collapsible guitar which is durable and possesses excellent sound characteristics.

BACKGROUND AND FIELD OF THE INVENTION

It has been previously proposed to design and construct stringed instruments, such as, acoustic guitars in such a way that they can be broken down for ease of carrying or handling. For example, in my prior U.S. Pat. No. 4,686,882 entitled "EXPANDABLE AND COLLAPSIBLE ACOUSTIC GUITAR", hinged wing portions can be expanded away from a guitar body to form a sound chamber with the body, and a neckpiece along with the wing portions are foldable over the body to form a compact unit when not in use. Although this basic construction is very useful, it does possess certain limitations with respect to durability of construction and tonal characteristics particularly with guitars and other musical instruments having large sound chambers.

Among other problems associated with collapsible stringed instruments and especially those which employ sound chambers composed of wood, fiberglass or plastic materials is a tendency to become warped or misaligned under repeated use or when subjected to different temperature and humidity conditions. Furthermore, it has been found that the sound chamber when expanded should be fully enclosed and not subject to air leakage between the moving parts of the sound chamber. For example, referring to my earlier patent, it was found that the collapsible wing sections of the guitar should contain a fairly tight air and vibration-conducting seal with the central portion or body for most effective development of the proper sound or tonal characteristics but at the same time be capable of being retracted or folded together over the body when in the collapsed position.

It is therefore proposed to provide for an improved collapsible sound chamber which is adaptable for use in various stringed musical instruments and which is capable of being disassembled into a compact unit for ease of storage and handling.

SUMMARY OF THE INVENTION

It is therefore an object of the present invention to provide for a novel and improved musical instrument which is collapsible into a compact unit and is specifically adaptable for use in providing a collapsible sound chamber for stringed instruments, such as, guitars.

Another object of the present invention is to provide in a musical stringed instrument for a collapsible sound chamber of durable construction and which is subject to minimal warpage or misalignment under repeated use.

It is a further object of the present invention to provide in a guitar for a novel and improved soundboard and reinforcing means therefor wherein the reinforcing means are adjustable to compensate for any tendency of the soundboard to warp or become misaligned.

It is a further object of the present invention to provide in an acoustic guitar for a detachable neck assembly which can be conveniently stored within the body section when not in use.

An additional object of the present invention is to provide in a collapsible guitar for a body having removable wing sections that are releasably connected to opposite sides of the body to form a unitary sealed enclosure; and further wherein a collapsible leg rest is connected to one of the wing sections.

In accordance with the present invention, a stringed musical instrument has been devised of the type having a soundboard and an elongated fingerboard extending from one end of the soundboard, the improvement comprising a hollow body having a top panel containing the soundboard, a bottom panel, end walls joining opposite ends of the top and bottom panels together with opposite sides of the body being left open, side wings of generally triangular configuration on opposite sides of the body, each having top and bottom wing panels and each disposed in facing relation to one of the opposite sides of the body, and releasable connector means traversing opposite free edges of the top and bottom panels and the top and bottom wing panels for releasably connecting the wing panels to the opposite sides of the body whereby to define a common sound chamber therebetween. The releasable connector means is so constructed and arranged as to slidably but releasably connect the wing portions to the body and preferably are defined by complementary slide members extending the substantial length of the top and bottom body panels and wing panels.

The wing panels are dimensioned so that they can be disposed in overlapping relation to the body when disconnected from the slides on the body panels.

The fingerboard is releasably connected at one end of the body and a novel form of reinforcement is provided to resist any bowing of the top panel of the body as well as to resist any tendency of the end walls of the body to be drawn out of proper relationship to the top and bottom panels when tension is applied to the strings which are directed along the fingerboard and top panel of the body.

A leg rest may be positioned on one of the wing panels and is preferably hinged at one end to a wing panel with the opposite end of the leg rest releasably secured so as to assume a generally triangular configuration to facilitate supporting of the guitar on either leg of the player when in the seated position.

The body is dimensioned with respect to the fingerboard such that the fingerboard can be easily stowed within the body when not in use, and the wing panels may be placed in overlapping relation to the body so as to form a compact, generally rectangular unit.

The above and other objects, advantages and features of the present invention will become more readily appreciated and understood from a consideration of the following detailed description of preferred and alternate forms thereof when taken together with the accompanying drawings, in which:

DETAILED DESCRIPTION OF THE PREFERRED EMBODIMENT

Figure 1:
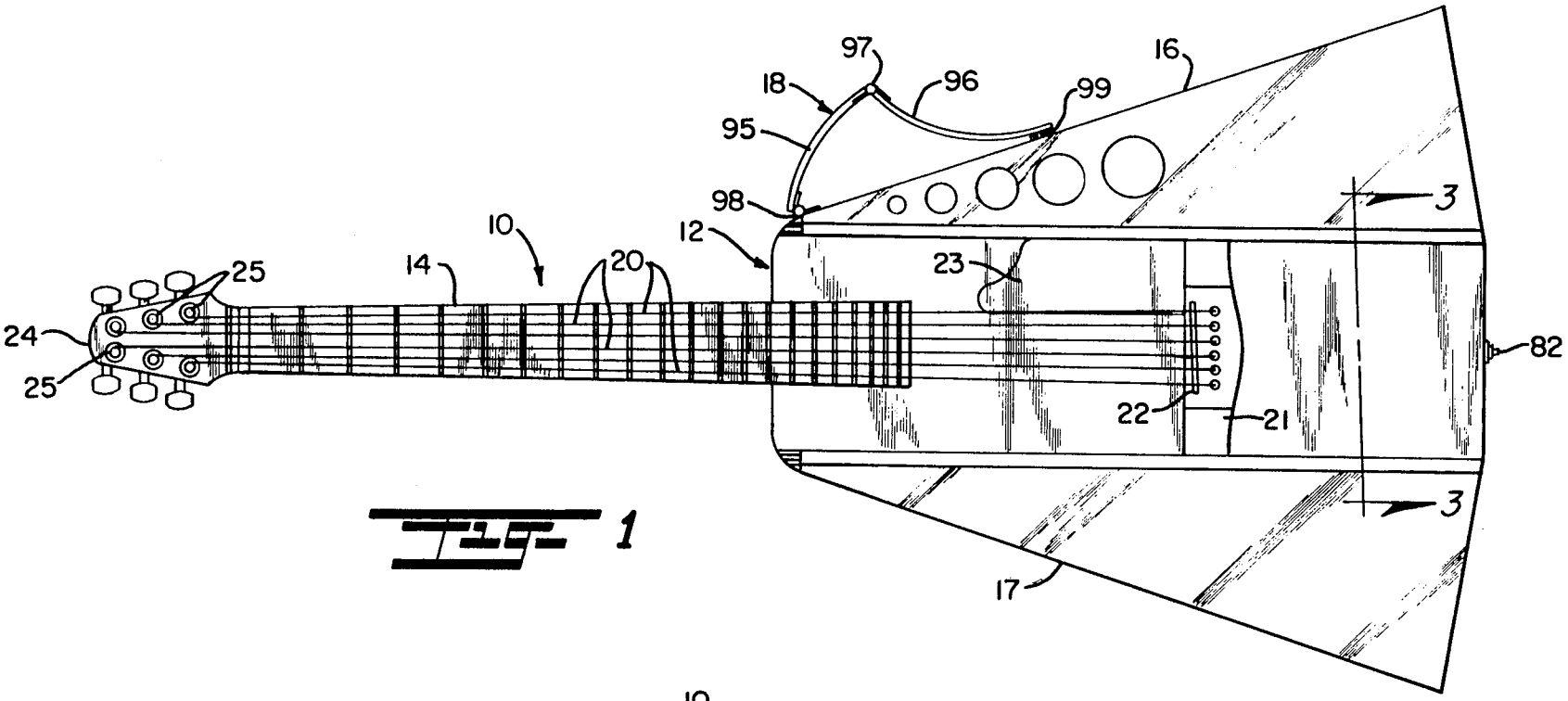
FIG. 1 is a top plan view of a preferred form of invention illustrated in a guitar and with the component parts thereof shown in the expanded, playing position.
Figure 2:
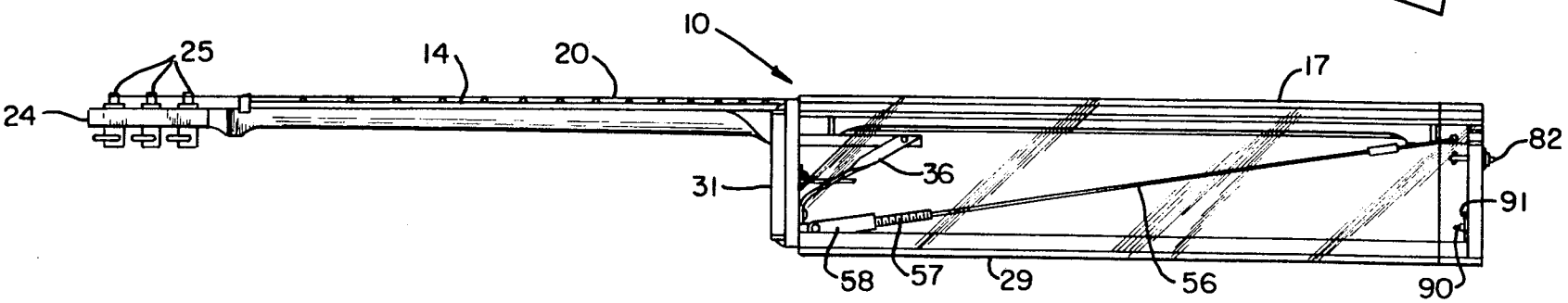
FIG. 2 is a side view in elevation of the preferred form of invention shown in FIG. 1.

Referring in more detail to the drawings, a preferred form of acoustical guitar 10 is illustrated in FIGS. 1 and 2 and which is broadly comprised of a hollow, generally rectangular body 12, a fingerboard and neck 14 releasably secured to one end of the body 12 and extending, for purposes of reference, in a rearward direction away from the body. Opposite lateral wing portions 16 and 17 are releasably secured to opposite sides of the body 12 and diverge in a forward direction so as to form with the body a common enclosure or sound chamber. One of the wing portions 16 includes a leg rest 18. Strings 20 extend rearwardly from a saddle portion 21 on the top surface of the body over a bridge 22 and the fingerboard 14 for attachment to pegs 25 on peghead 24 at the rearward free end of the fingerboard and neck 14.

The preferred form of guitar body 12, as shown in more detail in FIGS. 4 to 7 and 9, comprises a top panel 28, bottom panel or back 29 and opposite end walls 30 and 31 which rigidly interconnect the top and bottom panels 28 and 29 with the top and bottom panels disposed in spaced parallel relation to one another and the opposite end panels 30 and 31 in spaced parallel relation to one another. Preferably, the panels are composed of one of a number of wood, carbon ply, plastic or fiberglass materials, or a combination of same, employed in the construction of guitars. In a conventional manner, the saddle 21 is attached to an intermediate portion of the top panel 28 to provide a fixed support for the strings 20, and the bridge 22 is removably positioned on the saddle in proximity to the attachment of the strings 20. A suitable pick guard 23 extends along the top panel 28 for a limited distance from the saddle along one side of the strings 20, and a cavity or cradle 34 is provided at the rearward end of the top panel for releasable insertion of the leading end or tail end of the neck 14. The cavity 34 extends through the upper portion of the end wall 31, and horizontal frame members or angles 35 extend forwardly along the opposite lower corners of the cavity 34 from the end wall 31 and are supported by angular brace members 36 which extend upwardly from the lower end of the end wall 31. Fasteners 37 secure lower ends of the braces 36 to the end wall 31, and a horizontal support plate 38 is positioned on the frame members 35 as best seen from FIG. 10. Upstanding retainer posts 39 are screwed directly into the end wall 31 to releasably secure the neck 14 within the cavity in a manner to be described.

Figure 3:
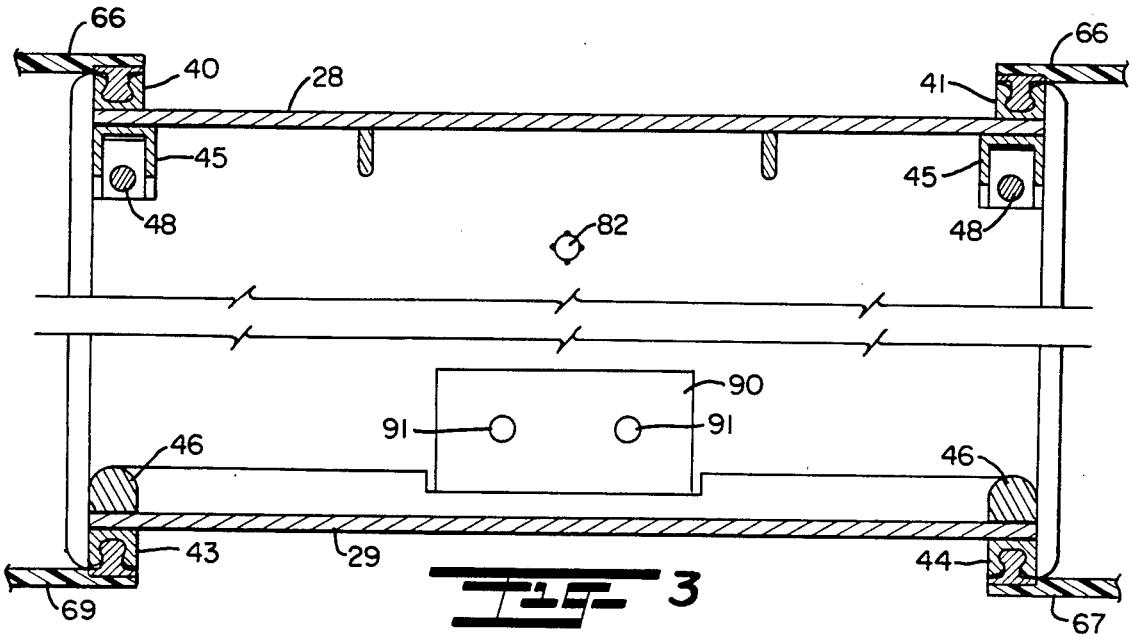
FIG. 3 is a cross-sectional view taken about lines 3—3 of FIG. 1.
Figure 6:
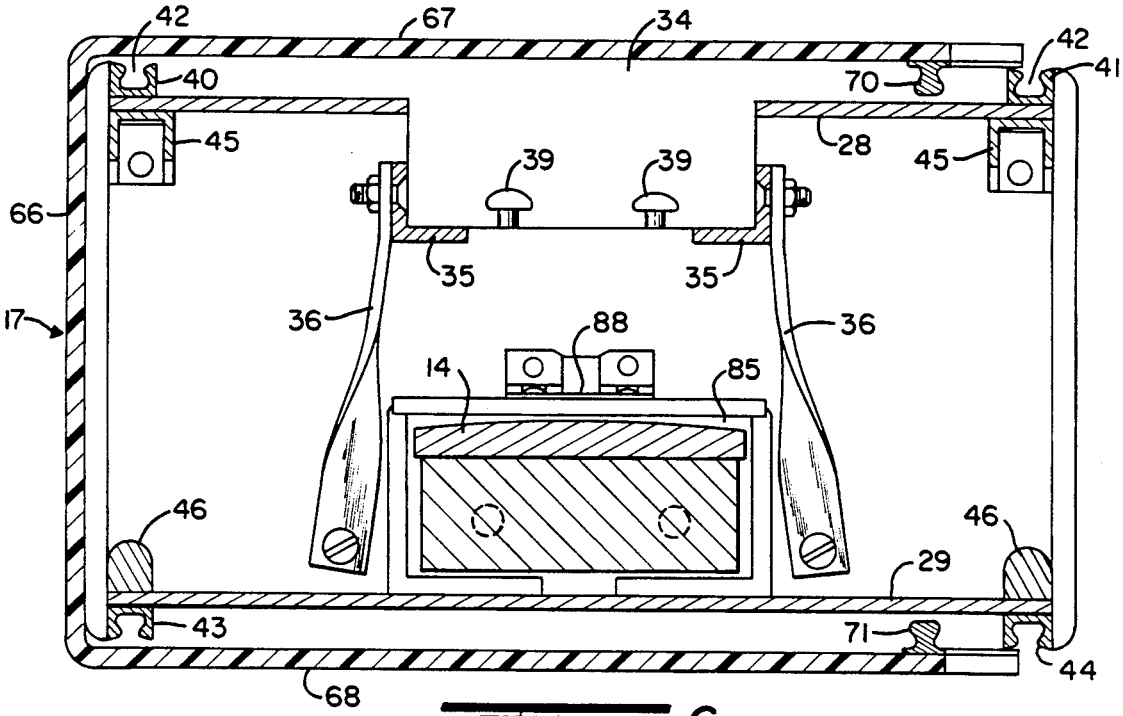
FIG. 6 is an enlarged cross-sectional view taken about lines 6—6 of FIG. 4.

In order to releasably secure the wing portions 16 and 17 to the body, there is shown in FIGS. 3 and 6 a pair of upper guide members 40 and 41 extending along opposite sides of the top panel 28, the guide members disposed in spaced parallel relation to one another and each guide member being generally channel-shaped to define an upwardly directed keyhole shaped opening 42. Lower guide members 43 and 44 extend along the underside of the bottom panel 29 and are aligned respectively with the upper guides 40 and 41. The upper guides 40 and 41 are united to the upper surface and reinforced by downwardly directed channels 45, each of the channels 45 being straight-walled and permanently attached to the underside of the top panel 28 and end wall 31. Reinforcing members 46 extend along opposite sides of the bottom panel 29 directly behind the lower guide members 43 and 44.

Figure 5:
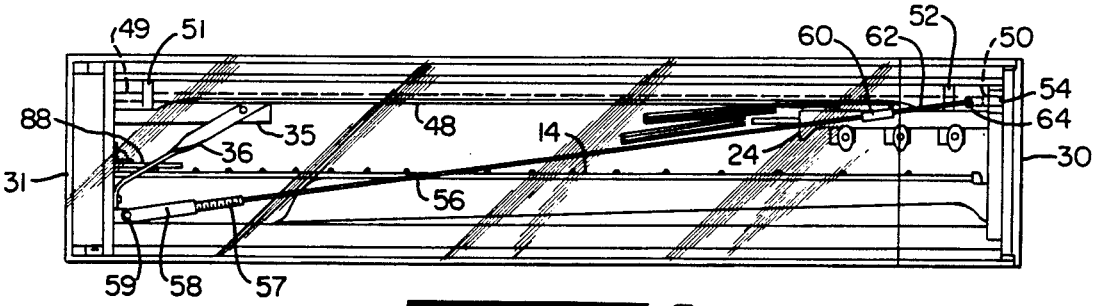
FIG. 5 is a side view taken about lines 5—5 of FIG. 4.
Figure 9:
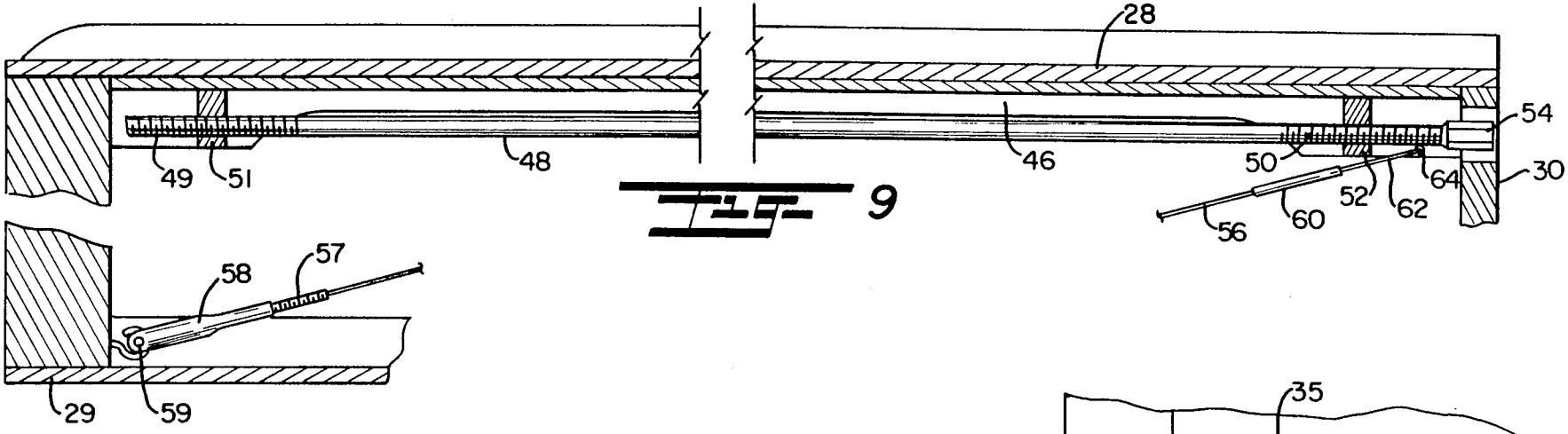
FIG. 9 is an enlarged fragmentary view partially in section of the soundboard of the preferred form of invention.

As best seen from FIGS. 5 and 9, a truss rod 48 is inserted within each channel 45, each rod including opposite threaded ends 49 and 50. The threaded ends 49 and 50 have opposite lefthand and righthand threading and are retained in the channel by nuts 51 and 52 which fit into notches within each channel 45 so that the nuts are fixed with respect to the threaded ends. A wrenchapplying end portion 54 is preferably in the form of a hexagonal socket which projects through an opening in the forward end wall 30 and which, when rotated, will threadedly adjust the rod 48 with respect to the nuts 51 and 52. Accordingly, when torque is applied to the rod tending to contract the nuts 51 and 52 toward one another, an upward bending force will be applied through the channel and to the top panel 28. Conversely, opposite torque or rotation applied to the socket 54 and rod 48 tending to spread the nuts will impart a slight downward bending moment through the top panel 28. Either adjustment will tend to counteract any tendency of the panel to bow or warp, for example, as a result of the tension from the strings; and of course the truss rod assembly as described will serve to reinforce the top panel.

An additional means of reinforcement takes the form of a cable or wire 56 which runs diagonally from the lower edge of the rearward end wall 31 upwardly to the forward end of the channel 45. A threaded adapter 57 serves to adjustably secure the lower end of the cable 56 to a complementary threaded end portion 58 which is pivotally attached as at 59 to the end wall 31. A splice 60 binds cable end portion 62 to the cables 56, and the cable end portion 62 is pivotally connected as at 64 to the channel 45. The cable tensioning assembly primarily serves to maintain precise perpendicularity between the end walls 30, 31 and top and bottom panels 28 and 29. Any adjustment by tightening or loosening the cable is effected through rotation of the threaded adapter 57.

It is important to note that the combination of the truss rod and cable assemblies affords a means not only of reinforcement but of maintaining precise alignment between the various parts of the body. For example, it is important that the proper alignment be established between the strings 20 and the bridge 22; also that the guide members 40, 41 and 43, 44 be aligned for slidable attachment of the wing portions 16 and 17. In this relation, the wing portions 16 and 17 are correspondingly comprised of a sidewall 66 which is united to top and bottom wing panels 67 and 68; and an end wall 69 is similarly united to each of the top and bottom wing panels 67, 68 and the sidewall 66 so as to result in a generally triangular section. Upper and lower guide tracks 70 and 71 extend along free edges of the panels 67 and 68 and project inwardly in facing, aligned relation to one another. The guide tracks 71 are of a crosssectional configuration complementary to the channels 42 of the guide members 40, 41 and 43, 44. In this way, the wing panels 16 and 17 can be slidably attached to opposite sides of the body 12 by insertion of the track members 70, 71 into the aligned channels 42, 43 or 41, 44 on opposite sides of the body 12, as best seen from FIG. 1, thereby resulting in a common chamber or enclosure with the hollow body 12. Preferably, the guide tracks 70, 71 and channels 40–41 and 43–44 are composed of a metal, composite, fiberglass or plastic material, which will establish an airtight and vibrationally conducting seal between the wing panels 16, 17 and the body 12 when in assembled relation as illustrated in FIG. 3.

Figure 7:
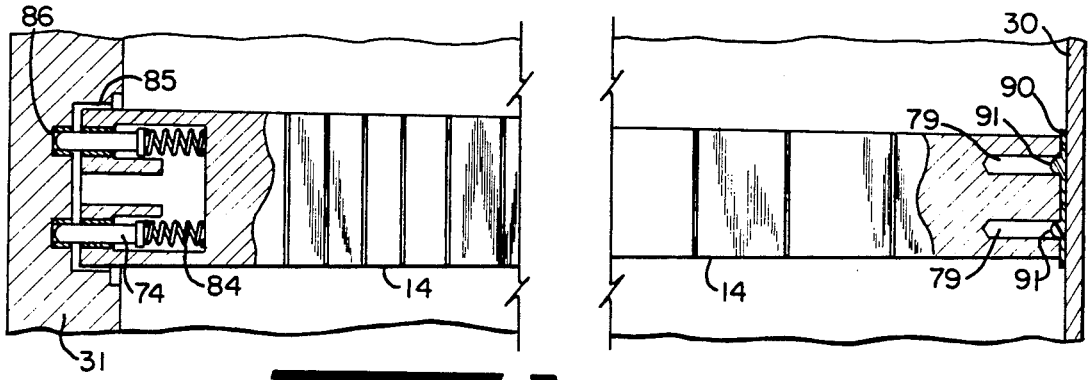
FIG. 7 is an enlarged view partially in section showing the neck assembly in the stored position.
Figure 8:
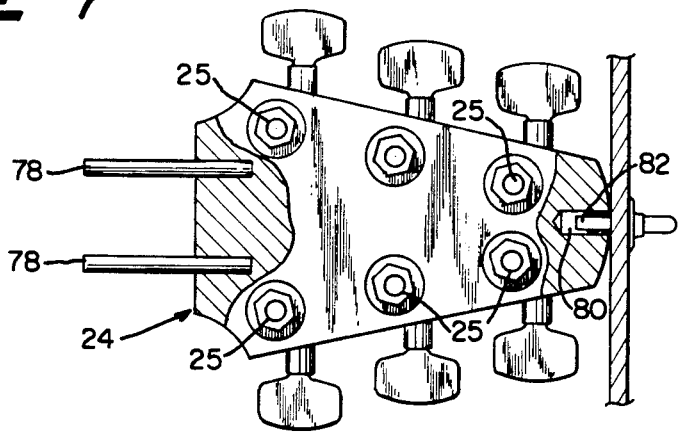
FIG. 8 is an enlarged fragmentary view, partially in section, of the peg head in its stored position.
Figure 10:
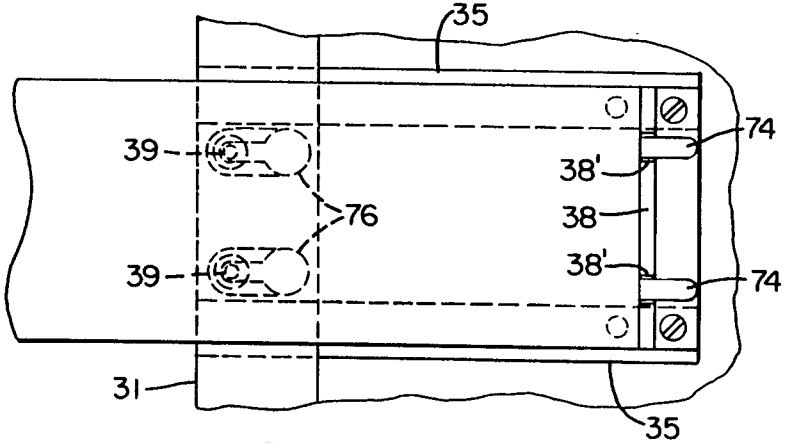
FIG. 10 is a top plan view illustrating in more detail the connection of the neck assembly to the body.

In the preferred form, the fingerboard 14 is of elongated generally rectangular configuration. Its leading end is provided with a pair of spaced, forwardly directed pins 74 at its leading edge for insertion through slots 38' in the crossbar 38 of the cavity 34 as shown in FIG. 10. A pair of keyhole shaped slots 76 are formed in a steel plate mounted to the undersurface of the leading end of the neck just rearwardly of the pins for alignment with the retainer posts 39 in the cavity 34. When the keyhole shaped slots 76 are aligned with their enlarged ends over the retainer posts and advanced forwardly so that the posts advance into the narrow ends of the slots, the pins 74 will simultaneously advance through the slots 38' so as to be assembled in the manner illustrated in FIGS. 1 and 10. The strings 20 are attached to the saddle and adjusted in a well-known manner through rotation of the pegs 25 so that the neck is securely attached in place within the cavity. Preferably, the peghead 24 is removably attached to the neck 14 by connecting pins 78 extending forwardly from an end of the peghead for insertion into bores 79 at the rearward end of the neck 14, as illustrated in FIGS. 7 and 8.

The opposite end of the peghead 24 includes a bore 80 which is sized for receiving a spring-loaded pin element 82 in the end wall 31 of the body. In this way, the neck 14 can be most conveniently sized for storage within the body 12 when not in use, as shown in FIG. 5. To this end, the pins 74 are yieldingly mounted within the end of the neck under the urging of coiled spring members 84 so as to normally project outwardly for insertion through the slots 38' in the crossbar 38 of the cavity 34. In order to store the neck within the body 12, for example, in the relationship illustrated in FIGS. 5 to 7, the pins 74 must be retracted in order to clear the inner edge of the end wall 31 and advance into alignment with an inset or recessed portion 85. Bores 86 in the inset portion 85 are aligned for insertion of the spring-loaded pins 74. A bracket or hinged door 88, as shown in FIGS. 5 and 6, is mounted on the inner surface of the end wall 31 to extend horizon tally away from the upper edge of the inset portion 85. When the door is in the elevated or open position, the recessed portion 85 is exposed to receive the neck within the body 12. When the door is closed, it simply covers the recessed portion 85. Slight protuberances 91 are disposed in horizontally spaced relation on a common support plate 90 at the lower end of the inner surface of the end wall 30 so that the spaced bores 79 at the peghead end of the neck 14 will move into alignment with the protuberances 91 when the pins 74 are properly seated within the openings 86. For this purpose, the openings 86 are of limited depth so that the spring-loaded pins will be mounted under a slight degree of compression causing the opposite end of the fingerboard to bear firmly against the plate 90. Again, the peghead 24 is separately stored by snapfitting insertion of the plunger 82 into the bore 80 as shown in FIGS. 5 and 8.

In practice, the wing panel section 16 may be referred to as the treble wing and the wing panel section 17 the bass wing. The treble wing 16 has a series of openings 94 in the top panel portion, the openings being of progressively reduced size toward the tapered or rearward end of the panel section. In addition, the leg rest 18 is mounted on the sidewall 66 of the panel and preferably comprises a combination of a convex section 95 and concave section 96 hinged together as at 97. The convex section 95 is hinged at one end 98 to the rearward end of the sidewall 66, and the forward or leading end of the concave section 96 has a Velcro strip 99 for attachment to a complementary Velcro strip 99' on the sidewall 66. In this way, the concave section 96 of the leg rest will serve as a convenient means of support on the thigh of the musician. When not in use, the concave section can be released from attachment at its leading end 99 to the sidewall and folded over the convex section 95 then the sections 95 and 96 can lay relatively flush with the sidewall, for example, as illustrated in FIG. 4.

Figure 4:
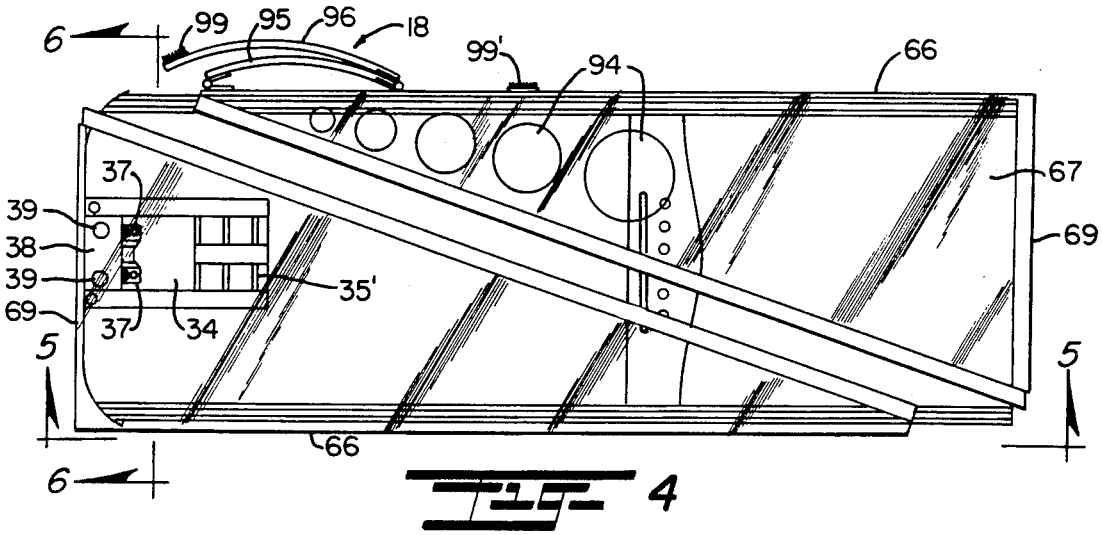
FIG. 4 is a top plan view of the preferred form of present invention shown in the collapsed position.

FIG. 4 further illustrates the disposition of the wing panels 16 and 17 in the stored position. Specifically, each wing panel 16 and 17 is released from engagement with the guide members 40, 41 and 43, 44. The treble wing 16 is placed over the front end of the body 12 so that the end wall 69 is substantially coextensive with and overlapping the end wall 30 of the body 12. The bass wing 17 is placed over the rearward end of the body such that its end wall 69 is substantially coextensive with and overlapping the end wall 31.

As a preliminary to placement of the wing panels 16 and 17 over the body, it is necessary to first remove the neck 14 from the body 12 by loosening the strings 20, releasing the strings 20 from the saddle and then releasing the leading end of the fingerboard 14 from the cavity 34. The peghead 24 is then detached from the end of the neck 14 and inserted into the body for connection to the plunger 82, as shown in FIG. 8. The neck 14 with the peghead removed is inserted into the interior of the body by advancing the trailing end containing the pins 74 into partial registry with the socket portion 85 followed by aligning the bores 79 at the opposite end with the protuberances 90.

In assembling the guitar, the wing panels are removed from the body 12, following which the neck 14 is unseated by moving the neck 14 rearwardly to increase the compression on the pins 74 sufficiently for the bores 79 to clear the protuberances 90. The fingerboard is then tilted out through either side. The peghead 24 is removed from the body by depressing the release button 82 and, while keeping it depressed, moving the peghead slightly toward the end wall 31 of the body to disengage it from the button 82. The wing panels 16 and 17 are assembled onto the body by engaging and sliding each of their track members, starting at the end wall 30 of the body, through the respective channels 42 on opposite sides of the body as previously described. The peghead 24 is then assembled onto the neck with the tuning posts 25 on the same side as the fingerboard. The keyhole plate at the opposite end is then lowered onto the retainer posts in the cavity 34 and, once engaged, is advanced forwardly to slide the neck toward the bridge. The strings are then attached as described so as to retain the neck and fingerboard securely in position with respect to the body 12.

Any cable 56 adjustments required to the body should be done prior to assembly of the wing panels, or by removing the wing panels. Most importantly, when the strings 20 are tightened, they will create a downward moment about the leading end of the neck 14. This downward force will in turn impart a rearwardly and horizontally directed force against the end wall 31 tending to move the lower ends of both end walls 30 and 31 in a rearwardly inclined direction. The adjustable cable 56 overcomes and counteracts this moment arm by regulating its tension through the adjustable connector 58. Similarly, any tendency of the top panel 28 to become distorted or bowed as a result of the string tension is effectively counteracted by adjusting the truss rods 48 as described. Utilization of the adjustable brace members or cables 56 and truss rods 48 are of particular significance in maintaining alignment between the body and wing portions in a collapsible guitar of the type described. Nevertheless, it will be apparent that the brace and truss rod assembly would have useful application to other stringed musical instruments.

It is therefore to be understood that while a preferred form of invention has been set forth and described herein, various modifications and changes may be made in the construction and arrangement of parts without departing from the spirit and scope of the present invention as defined by the appended claims.

I claim:

1. In a stringed musical instrument having a soundboard and an elongated fingerboard extending from one end of said soundboard, the improvement comprising:

a hollow body having a top panel containing said soundboard, a bottom panel, end walls joining opposite ends of said top and bottom panels together with opposite sides of said body being left open;

side wing portions of generally triangular configuration disposed on said opposite sides of said body, each said wing portion having top and bottom wing panels, a sidewall and end wall joining said top and bottom wing panels and one side of each said wing portion opposite to said sidewall being left open and disposed in facing relation to one of said opposite sides of said body; and releasable connector means traversing opposite free edges of said top and bottom panels and said top and bottom wing panels for slidably and releasably connecting said wing portions to said opposite sides of said body whereby to define a common sound chamber with said sidewalls of said wing panel portions diverging from said one end of said body, said side wing portions slidable in a direction substantially parallel to said fingerboard into and away from connected relation to said body.

2. In a stringed musical instrument according to claim 1, including a leg rest on one of said sidewalls, said leg rest connected in hinged relation at one end to one of said sidewalls of said wing portions and including means releasably connecting an opposite end of said leg rest to one of said sidewalls whereby to define a generally triangular extension of said one of said sidewalls.

3. In a stringed musical instrument according to claim 1, said releasable connector means defined by complementary slide members extending the substantial lengths of said top and bottom panels and said top and bottom wing panels.

4. In a stringed musical instrument according to claim 1, said wing panels being sized for disposition in overlapping relation to said body with said end walls of said panel portions each substantially coextensive with one of said end walls of said body and said sidewalls overlying and parallel to said opposite sides of said body.

5. In a stringed musical instrument according to claim 4, each of said panel portions having triangular edges disposed in closely spaced parallel relation to one another when in the stored position on said body.

6. In a stringed musical instrument according to claim 1, including elongated truss rods extending along opposite sides of said body, and adjustable tensioning means associated with each of said truss rods for adjusting the tension in said rods whereby to counteract any bowing of said top panel.

7. In a stringed musical instrument according to claim 6, a channel member extending along opposite sides of said top panel, one of said truss rods disposed in each of said channel members, and said adjustable tensioning means disposed at opposite ends of each of said truss rods.

8. In a stringed musical instrument according to claim 7, said tensioning means including oppositely threaded nuts positioned at opposite ends of each said channel member, each of said truss rods having complementary threaded end portions threadedly engageable with said nuts and means for turning one end of said truss rods whereby to threadedly adjust the tension of each said truss rod.

9. In a stringed musical instrument according to claim 6, a brace or cable member extending diagonally between one end of said bottom panel and one end of said top panel.

10. In a stringed musical instrument according to claim 9, said brace or cable member including tension adjusting means disposed at least at one end thereof.

11. In a stringed musical instrument according to claim 10, said brace member defined by a guy wire and said tension adjusting means including a threadedly adjustable tension member at one end of said guy wire.

12. In a stringed musical instrument according to claim 1, said neck including means releasably connecting said neck to said top panel, said neck being of a length substantially corresponding to the length of the hollow interior of said body for insertion through one side thereof, and securing means for releasably securing said fingerboard within the hollow interior of said body.

13. In a stringed musical instrument according to claim 1, one end of said top panel including a recess, said fingerboard including a neck portion insertable into said recess in said top panel, and means in said recess for detachably connecting said neck to said body.

14. In a stringed musical instrument having a sound chamber and an elongated fingerboard and neck extending from one end of said sound chamber including a plurality of strings extending longitudinally of said fingerboard and said sound chamber and string tensioning means for adjusting the tension of said strings, the improvement comprising:

means releasably connecting said neck to said sound chamber, said sound chamber including a hollow body having a top panel, a bottom panel, and end walls joining opposite ends of said top and bottom panels together, elongated truss rods extending along opposite sides of said body parallel to said top panel, and adjustable rod tensioning means for adjusting the tension in said rods whereby to counteract any bowing of said top panel; and adjustable bracing means extending diagonally between opposite ends of said sound chamber including means for regulating the tension in said adjustable bracing means.

15. In a stringed musical instrument according to claim 14, said bracing means including a guy wire, and said tension regulating means including a threadedly adjustable tension member at one end of said guy wire.

16. In a stringed musical instrument according to claim 15, said fingerboard including a neck portion at one end insertable into a cavity at one end of said sound chamber, and connecting means in said cavity for detachably connecting said neck portion to said sound chamber including a cradle disposed in said cavity having spaced upstanding retainer posts said neck portion provided with retainer slots releasably engaging said retainer posts.

17. In a stringed musical instrument according to claim 14, including a channel member extending along opposite sides of said top panel, one of said truss rods disposed in each of said channel members, and said rod tensioning means disposed at opposite ends of each of said truss rods.

18. In a stringed musical instrument according to claim 17, said rod tensioning means including oppositely threaded nuts positioned at opposite ends of said channel member, each of said truss rods having complementary threaded end portions threadedly engageable with said nuts and means for turning one end of said truss rods whereby to threadedly adjust the tension of each said truss rod.

* * * * *